US007598331B2

(12) United States Patent
Barcus et al.

(10) Patent No.: US 7,598,331 B2
(45) **Date of Patent: *Oct. 6, 2009**

(54) PROCESSES FOR MAKING TEMPORARY WET STRENGTH ADDITIVES

(75) Inventors: Robert Lee Barcus, Cincinnati, OH (US); Khosrow Parviz Mohammadi, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 613 days.

This patent is subject to a terminal disclaimer.

(21) Appl. No.: 11/355,667

(22) Filed: Feb. 16, 2006

(65) Prior Publication Data

US 2006/0180288 A1 Aug. 17, 2006

Related U.S. Application Data

(63) Continuation-in-part of application No. 11/059,950, filed on Feb. 17, 2005, now Pat. No. 7,259,218.

(51) Int. Cl.
*C08F 8/06* (2006.01)

(52) U.S. Cl. ..... 526/320; 526/319; 525/330.3; 525/383

(58) Field of Classification Search ..... 526/319, 526/320; 525/330.3, 383
See application file for complete search history.

(56) References Cited

U.S. PATENT DOCUMENTS

| | | | | |
|---|---|---|---|---|
| 3,691,153 | A * | 9/1972 | Vemuri | 536/114 |
| 4,603,176 | A | 7/1986 | Bjorkquist et al. | |
| 4,675,394 | A * | 6/1987 | Solarek et al. | 536/43 |
| 4,981,557 | A | 1/1991 | Bjorkquist et al. | |
| 5,008,344 | A | 4/1991 | Bjorkquist | |
| 5,085,736 | A | 2/1992 | Bjorkquist | |
| 5,138,002 | A | 8/1992 | Bjorkquist | |
| 5,510,004 | A | 4/1996 | Allen | |
| 5,760,212 | A * | 6/1998 | Smith | 536/123.1 |
| 5,830,320 | A | 11/1998 | Park et al. | |
| 5,955,567 | A | 9/1999 | Bigorra Llosas et al. | |
| 6,124,124 | A * | 9/2000 | Brady et al. | 435/190 |
| 6,130,303 | A | 10/2000 | Neff et al. | |
| 6,149,769 | A | 11/2000 | Mohammadi et al. | |
| 6,197,919 | B1 | 3/2001 | Crisp et al. | |
| 6,228,126 | B1 | 5/2001 | Cimecioglu et al. | |
| 6,281,291 | B1 | 8/2001 | Bazaj et al. | |
| 6,368,456 | B1 | 4/2002 | Cimecioglu et al. | |
| 6,379,494 | B1 | 4/2002 | Jewell et al. | |
| 6,409,881 | B1 | 6/2002 | Jaschinski | |
| 6,498,269 | B1 | 12/2002 | Merbouh et al. | |
| 6,518,419 | B1 | 2/2003 | Van Der Lugt et al. | |
| 6,524,348 | B1 | 2/2003 | Jewell et al. | |
| 6,540,876 | B1 | 4/2003 | Cimecioglu et al. | |
| 6,562,195 | B2 | 5/2003 | Cimecioglu et al. | |
| 6,582,559 | B2 * | 6/2003 | Thornton et al. | 162/175 |
| 6,586,588 | B1 * | 7/2003 | Cimecioglu et al. | 536/104 |
| 6,635,755 | B1 | 10/2003 | Jaschinski et al. | |
| 6,695,950 | B1 | 2/2004 | Cimecioglu et al. | |
| 6,716,976 | B1 | 4/2004 | Jetten et al. | |
| 6,770,755 | B1 | 8/2004 | Gunnars et al. | |
| 6,824,645 | B2 | 11/2004 | Jaschinski et al. | |
| 6,831,173 | B1 | 12/2004 | Jetten et al. | |
| 6,872,821 | B2 | 3/2005 | Cimecioglu et al. | |
| 6,875,861 | B1 | 4/2005 | Besemer et al. | |
| 7,125,469 | B2 | 10/2006 | Barcus et al. | |
| 7,217,339 | B2 | 5/2007 | Mohammadi et al. | |
| 7,258,763 | B2 | 8/2007 | Barcus et al. | |
| 7,259,218 | B2 * | 8/2007 | Barcus et al. | 526/320 |
| 2002/0056534 | A1 | 5/2002 | Thomas | |
| 2002/0104633 | A1 | 8/2002 | Sun et al. | |
| 2003/0022568 | A1 | 1/2003 | Branham et al. | |
| 2003/0026963 | A1 | 2/2003 | Chang et al. | |
| 2003/0032352 | A1 | 2/2003 | Chang et al. | |
| 2003/0073871 | A1 * | 4/2003 | Fritz-Langhals et al. | 568/322 |
| 2003/0088014 | A1 | 5/2003 | Edwards et al. | |
| 2003/0208062 | A1 | 11/2003 | Cimecioglu et al. | |
| 2004/0010137 | A1 | 1/2004 | Jaschinski et al. | |
| 2005/0082023 | A1 | 4/2005 | Barcus et al. | |
| 2005/0082024 | A1 | 4/2005 | Barcus et al. | |
| 2005/0082026 | A1 | 4/2005 | Mohammadi et al. | |

FOREIGN PATENT DOCUMENTS

| | | |
|---|---|---|
| EP | 0 350 277 A2 | 1/1990 |
| GB | 2 324 615 A | 10/1998 |

(Continued)

OTHER PUBLICATIONS

"Thermal Transitions of Homopolymers: Glass Trnsitions (Tg) & Melting Point™ Temperatures", Brochure, Sigma Alrrich Corporation URL:<http://www.sigmaaldrich.com/aldrich/brohure/al_pp_transitions.pdf>.

(Continued)

*Primary Examiner*—Eric Hug
*Assistant Examiner*—Dennis Cordray
(74) *Attorney, Agent, or Firm*—C. Brant Cook

(57) ABSTRACT

Processes for making temporary wet strength additives, more particularly, processes for oxidizing a homo-crosslinking monomeric unit present in a polymer comprising the homo-crosslinking monomeric unit and a cationic monomeric unit to produce a temporary wet strength additive are provided.

17 Claims, No Drawings

FOREIGN PATENT DOCUMENTS

| | | | |
|---|---|---|---|
| WO | WO 95/07303 | A1 | 3/1995 |
| WO | WO 96/38484 | A1 | 12/1996 |
| WO | WO 99/23117 | A1 | 5/1999 |
| WO | WO 99/23240 | A1 | 5/1999 |
| WO | WO 00/11406 | | 3/2000 |
| WO | WO 01/00681 | A1 | 1/2001 |
| WO | WO 01/36491 | A1 | 5/2001 |
| WO | WO 01/38638 | A1 | 5/2001 |
| WO | WO 02/101144 | A1 | 12/2002 |

OTHER PUBLICATIONS

Huang, et al., "Polymerization of Diallyldimethylammonium chloride in Inverse Emulsion II", Die Angewandte Makromolekulare Chemie, 165, (1989), 2nd to last paragraph.

* cited by examiner

PROCESSES FOR MAKING TEMPORARY WET STRENGTH ADDITIVES

CROSS-REFERENCE TO RELATED APPLICATION

This application is a continuation-in-part application of U.S. application Ser. No. 11/059,950, filed Feb. 17, 2005 now U.S. Pat. No. 7,259,218.

FIELD OF THE INVENTION

The present invention relates to processes for making temporary wet strength additives, more particularly, to processes for the partial oxidation of a copolymer comprising a primary hydroxyl containing monomeric unit and a cationic monomeric unit to produce a temporary wet strength additive.

BACKGROUND OF THE INVENTION

Temporary wet strength resins for disposable tissue products are well known in the art. However, there is a continued need for new resins with better rates of wet tensile decay. The development of new resins often requires new monomers with protected aldehyde functional groups. An alternate approach is to carry out modification reactions on a polymer to introduce aldehyde functional groups. One well known example is the glyoxylation of cationic poly(acrylamide) copolymers. Other strategies that give wet strength resins with better rates of wet tensile decay are still needed.

Accordingly, the present invention describes a method to introduce aldehyde functional groups into a copolymer that results in temporary wet strength resins that provide high initial wet strength and very rapid decay rates.

SUMMARY OF THE INVENTION

The present invention fulfills the need described above by providing a method for making a temporary wet strength additive.

In one example of the present invention, a method for making a temporary wet strength additive comprising the step of oxidizing a portion of the primary alcohol groups that also function as reversible, homo-crosslinking sites of a cationic copolymer such that a temporary wet strength additive is produced, is provided.

In another example of the present invention, a method for making a temporary wet strength additive comprising the steps of:

a) providing a reversible, homo-crosslinking monomer;

b) providing a cationic monomer;

c) polymerizing the monomers from a) and b) above to produce a polymer comprising a reversible, homo-crosslinking monomeric unit and a cationic monomeric unit;

d) oxidizing a portion of the reversible, homo-crosslinking monomeric units to provide a temporary wet strength additive, is provided.

In yet another example of the present invention, a temporary wet strength additive made by a method according to the present invention, is provided.

Accordingly, the present invention provides methods for making temporary wet strength additives and temporary wet strength additives made thereby.

DETAILED DESCRIPTION OF THE INVENTION

Definitions

"Polymer" as used herein means a copolymer, terpolymer or other polymer having two or more monomeric units. The polymer of the present invention may be a homopolymer. The polymer of the present invention may comprise two or more different monomeric units.

"Co-crosslinking" as used herein means a reaction between the temporary wet strength additive of the present invention and a fiber whereby the temporary wet strength additive is covalently bonded to the fiber.

"Reversible, homo-crosslinking" as used herein means a reaction between the temporary wet strength additive of the present invention and another temporary wet strength additive of the present invention or a conventional temporary wet strength additive wherein the temporary wet strength additives are covalently bonded by forming an unstable, covalent bond.

"Unstable, covalent bond" as used herein means a covalent bond that is reversible in the presence of water and/or an aqueous fluid. A nonlimiting example of an unstable, covalent bond is a hemi-acetal bond formed by reacting a hydroxyl moiety with an aldehyde moiety.

"Stable, covalent bond" as used herein means a covalent bond that is not reversible in the presence of water and/or an aqueous fluid. A nonlimiting example of a stable, covalent bond is an amidol bond formed by reacting an amide moiety with an aldehyde moiety.

"Electrophilic moiety" as used herein means a moiety which is capable of accepting electrons from a nucleophilic moiety in order to form a covalent bond between the nucleophilic moiety and itself.

"Nucleophilic moiety" as used herein means a moiety which is capable of forming a covalent bond with an electrophilic moiety under chemical and/or physical conditions conventionally experienced during fibrous structure-making and/or sanitary tissue product-making processes and/or during storage and/or use of fibrous structures and/or sanitary tissue products comprising the temporary wet strength additives of the present invention.

"Non-nucleophilic moiety" as used herein means a moiety which is not capable of reacting with an electrophilic moiety to form a covalent bond under chemical and/or physical conditions conventionally experienced during fibrous structure-making and/or sanitary tissue product-making processes and/or during storage and/or use of fibrous structures and/or sanitary tissue products comprising the temporary wet strength additives of the present invention.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121. Unless otherwise specified, all molecular weight values herein refer to the weight average molecular weight.

"Fibrous structure" as used herein means a substrate formed from non-woven fibers. The fibrous structure of the present invention may be made by any suitable process, such as wet-laid, air-laid, sponbond processes. The fibrous structure may be in the form of one or more plies suitable for incorporation into a sanitary tissue product and/or may be in the form of non-woven garments, such as surgical garments including surgical shoe covers, and/or non-woven paper products such as surgical towels and wipes.

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

"Sanitary tissue product" as used herein means a soft, low density (i.e. < about 0.15 g/cm$^3$) web useful as a wiping implement for post-urinary and post-bowel movement cleaning (toilet tissue), for otorhinolaryngolical discharges (facial tissue), and multi-functional absorbent and cleaning uses (absorbent towels).

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

"Basis Weight" as used herein is the weight per unit area of a sample reported in lbs/3000 ft$^2$ or g/m$^2$. Basis weight is measured by preparing one or more samples of a certain area (m$^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples (m$^2$). The basis weight (g/m$^2$) is calculated by dividing the average weight (g) by the average area of the samples (m 2).

"Decay" as used herein means the percent loss of wet tensile strength.

Temporary Wet Strength Additives

Nonlimiting examples of temporary wet strength additives made by the methods of the present invention generally have weight average molecular weights of from about 20,000 to about 400,000 and/or from about 50,000 to about 400,000 and/or from about 70,000 to about 400,000 and/or from about 70,000 to about 300,000 and/or from about 100,000 to about 200,000.

The temporary wet strength additives of the present invention impart wet tensile strength properties and wet tensile decay properties to the fibrous structures and/or sanitary tissue products of the present invention.

It has been found that temporary wet strength additives with high weight average molecular weights (i.e. those in excess of 300,000) may decay unacceptably slow for consumer purposes. They may not achieve a wet tensile decay rate of better than 35-45% after 5 minutes and/or better than 50-65% after 30 minutes.

Further, it has been found that temporary wet strength additives with extremely low weight average molecular weights (i.e. those less than 70,000) may have very low wet strength and are may not be optimal as temporary wet strength additives for fibrous structures and/or sanitary tissue products.

The temporary wet strength additives in accordance with the present invention have the formula:

Structure I

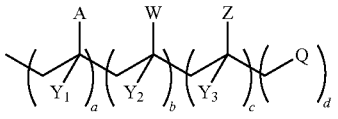

wherein: A (the moiety present on the co-crosslinking monomeric unit) is independently an electrophilic moiety, nonlimiting examples of which include the following:

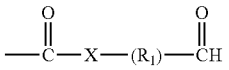

Z (the moiety present on the reversible, homo-crosslinking monomeric unit) is independently a nucleophilic moiety capable of forming an unstable covalent bond with the electrophilic moiety, nonlimiting examples of which include the following:

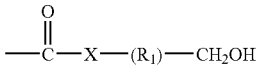

and X is independently —O—, —NH—, or —$NCH_3$—; and $R_1$ is a substituted or unsubstituted aliphatic group; $Y_1$, $Y_2$, and $Y_3$ are independently —H, —$CH_3$, or a halogen; Q is a cationic moiety; and W is a non-nucleophilic moiety or a nucleophilic moiety that does not form a stable covalent bond with the electrophilic moiety. Nonlimiting examples of moieties for W include water-soluble N,N-dialkyl acrylamide moieties and/or water-soluble carboxylic acid moieties.

The mole percent of a ranges from about 1% to about 20%, preferably from about 2% to about 15%, the mole percent of b ranges from about 0% to about 60%, preferably from about 0% to about 45%, the mole percent of c ranges from about 10% to about 90%, preferably from about 30% to about 80%, and d ranges from about 1% to about 40%, preferably from about 2% to about 20%, more preferably from about 5% to about 12%.

Unless otherwise expressly specified, values for a, b, c, and d shall be mole percentage values based upon the average number of monomeric units in the polymer backbone of the temporary wet strength additive of the present invention.

The monomeric units of the polymer backbone of the temporary wet strength additive of the present invention are randomly distributed throughout the polymer in ratios corresponding to the mole percentage ranges described herein.

Each class of monomeric units may include a single monomer or may include combinations of two or more different monomers within that class. The mole percent of each monomeric unit within a class of monomeric units may be independently selected.

a. Co-Crosslinking Monomeric Unit

The co-crosslinking monomeric unit of the temporary wet strength additives of the present invention comprises an electrophilic moiety and can be derived by the oxidation of a monomeric unit comprising a primary alcohol group as described for the reversible, homocrosslinking monomer unit.

b. Reversible, Homo-Crosslinking Monomeric Units

The reversible, homo-crosslinking monomeric unit of the temporary wet strength additives of the present invention comprises a nucleophilic moiety capable of forming an unstable, covalent bond with an electrophilic moiety (i.e. aldehyde moiety present on a co-crosslinking monomeric unit). As a result of this unstable covalent bond, the nucleophilic moiety can crosslink together two or more temporary wet strength additives, at least one of which is a temporary wet strength additive of the present invention, via the unstable covalent bond formed between the nucleophilic moiety present on one temporary wet strength additive and the electrophilic moiety present on another temporary wet strength additive. So in other words, a mixture comprising only temporary wet strength additives of the present invention may be crosslinked together via the nucleophilic moiety, as described above, or a mixture of temporary wet strength additives of the present invention with other conventional temporary wet strength additives my be crosslinked together via the nucleophilic moiety present on the temporary wet strength additives of the present invention.

A nonlimiting example of a suitable nucleophilic moiety is a hydroxyl-containing moiety.

The homo-crosslinking monomeric unit of the temporary wet strength additives of the present invention, i.e. monomer units having Z attached thereto in Formula I, can be derived from a monomer having the following structure:

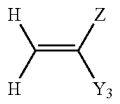

wherein $Y_3$ and Z are as defined above. If Z is:

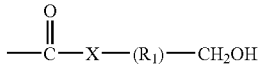

$R_1$ can be a substituted or unsubstituted, branched or linear aliphatic group. The aliphatic group preferably comprises a $C_1$-$C_{18}$ chain, more preferably a $C_1$-$C_7$ chain, even more preferably a $C_1$-$C_3$ chain.

Nonlimiting examples of suitable homo-crosslinking monomeric units include the following: 2-hydroxyethyl acrylate, 2-hydroxyethyl methacrylate, 3-hydroxypropyl acrylate, 3-hydroxypropyl methacrylate, 4-hydroxybutyl acrylate, 4-hydroxybutyl methacrylate, diethyleneglycol monomethacrylate, poly(ethyleneglycol) mono-acrylate, and poly (ethyleneglycol) mono-methacrylate.

c. Cationic Monomeric Units

The cationic monomeric unit can be derived from any polymerizable monomer which imparts a positive charge to the temporary wet strength additive of the present invention subsequent to polymerization. Cationic monomer units may and preferably do carry a positive electrostatic charge when dissolved in water. Suitable counterions can include chloride, fluoride, bromide, iodide, sulphate, methylsulfate, phosphate and the like.

Nonlimiting examples of suitable cationic monomeric units include 3-(methacryloylamino)propyl trimethyl ammonium chloride, 2-vinyl-N-methylpyridinium chloride, diallyldimethyl ammonium chloride, (p-vinylphenyl)trimethyl ammonium chloride, trimethyl (p-vinylbenzyl)ammonium chloride, 2-methylacrloyloxyethyl trimethyl ammonium methylsulfate, and 3-acrylamido-3-methylbutyl trimethyl ammonium chloride.

d. Non-Nucleophilic and/or Nucleophilic Monomeric Units

The non-nucleophilic and/or nucleophilic monomeric unit (the monomeric unit containing W) that does not form a stable covalent bond with the electrophilic moiety (i.e., aldehyde moiety present on a co-crosslinking monomeric unit) can optionally be incorporated into the temporary wet strength additive of the present invention.

The non-nucleophilic monomeric unit can be derived from a monomer having the following structure:

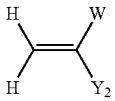

wherein W and $Y_2$ are as defined above, with $Y_2$ preferably being H. Preferably, W is hydrophilic. If W is a hydrophobic moiety, the amount incorporated (b) should be below levels that would result in a copolymer that is insoluble in water.

Nonlimiting examples of suitable non-nucleophilic, hydrophilic monomeric units are N,N-dimethyl acrylamide and methoxy poly(ethylene glycol) methacrylate.

Nonlimiting examples of non-nucleophilc, hydrophobic monomeric units include alkyl, especially $C_1$-$C_4$, acrylate and methacrylate esters and styrenes.

Nonlimiting examples of suitable non-nucleophilic monomeric units include methyl methacrylate, methyl acrylate, ethyl acrylate, n-propyl acrylate, iso-propylacrylate, n-propyl methacrylate, ethyl methacrylate, iso-propylmethacrylate, n-butyl acrylate, isobutyl acrylate, isobutyl methacrylate, n-butyl methacrylate, α-methyl styrene, benzyl acrylate and ethylhexyl acrylate.

Nonlimiting examples of nucleophilic monomeric units that do not form stable covalent bonds with the electrophilic moiety include carboxylic acids. Nonlimiting examples of suitable carboxylic acids include $C_{3-8}$ mono-carboxylic acids and $C_{4-8}$ di-carboxylic acids and may be selected from the group consisting of acrylic acid, methacrylic acid, 2-carboxyethyl acrylate, itaconic acid, their salts, and mixtures thereof.

It has been surprisingly found that fibrous structures and/or sanitary tissue products comprising a wet strength additive, especially a temporary wet strength additive, more especially a temporary wet strength additive of the present invention with a Tg of less than about 90° C. and/or between about 40° C. and about 90° C. and/or between about 43° C. and about 87° C. minimizes the negative impact of creping on wet tensile of the fibrous structure and/or sanitary tissue product. It also has been found the temporary wet strength additives of the present invention comprising a non-nucleophilic monomeric unit, such as methoxy poly(ethylene glycol) methacrylate and/or butyl acrylate for example, improves the softness of the fibrous structure and/or sanitary tissue product as compared to a fibrous structure and/or sanitary tissue product having a wet strength additive other than those described herein.

Without being bound by theory, it is believed that the wet strength additives of the present invention exhibit a lower Tg than conventional wet strength additives and thus, as a result avoid fracturing during a creping process. By not fracturing during a creping process, loss of wet tensile in a fibrous structure and/or sanitary tissue product comprising such a wet strength additive, especially where the wet strength additive exhibits a Tg of less than about 90° C., is mitigated or inhibited. However, if the Tg is below about 40° C., the cohesive strength of the polymer film may be insufficient to survive the creping process and lead to a loss of wet tensile in a fibrous structure and/or sanitary tissue product.

The temporary wet strength additives of the present invention can be made by a wide variety of techniques, including bulk, solution, emulsion, or suspension polymerization. Polymerization methods and techniques for polymerization are described generally in Encyclopedia of Polymer Science and Technology, Interscience Publishers (New York), Vol. 7, pp. 361-431 (1967), and Kirk-Othmer Encyclopedia of Chemical Technology, 3rd edition, Vol 18, pp. 740-744, John Wiley & Sons (New York), 1982, both incorporated by reference herein. See also Sorenson, W. P. and Campbell, T. W., Preparative Methods of Polymer Chemistry. 2nd edition, Interscience Publishers (New York), 1968, pp. 248-251, incorporated by reference herein, for general reaction techniques suitable for the present invention. Preferably, the temporary wet strength additives are made by free radical copolymerization, using water soluble initiators. Suitable free radical initiators include, but are not limited to, thermal initiators, redox couples, and photochemical initiators. Redox and photochemical initiators are preferred for polymerization processes initiated at temperatures below about 30° C. (86° F.). Such initiators are described generally in Kirk-Othmer Encyclopedia of Chemical Technology, 3rd edition, John Wiley & Sons (New York), Vol. 13, pp. 355-373 (1981), incorporated by reference herein. Typical water soluble initiators that can provide radicals at 30° C. or below include redox couples, such as potassium persulfate/silver nitrate, and ascorbic acid/hydrogen peroxide. A preferred method utilizes thermal initiators in polymerization processes conducted above 40° C. (104° F.). Water soluble initiators that can provide radicals at 40° C. (104° F.) or higher can be used. These include, but are not limited to, hydrogen peroxide, ammonium persulfate, and 2,2'-azobis(2-amidinopropane) dihydrochloride. In one especially preferred method, water soluble starting monomers are polymerized in an aqueous alcohol solvent at 60° C. (140° F.) using 2,2'-azobis(2-amidinopropane) dihydrochloride as the initiator. The solvent should typically contain at least about 10% by volume, of alcohol in order to prevent the polymerization reaction medium from gelling. Suitable alcohols for use in such reaction include low molecular weight alcohols such as, but not limited to, methanol, ethanol, 2-propanol, and butanol.

Another technique is a solution polymerization as described in U.S. Pat. No. 3,317,370, Kekish, issued May 2, 1967 and U.S. Pat. No. 3,410,828, Kekish, issued Nov. 12, 1968, both incorporated herein by reference. According to such process, the acrolein, or other aldehydic monomer, is copolymerized with a non-nucleophilic, water soluble, nitrogen-heterocyclic polymerizable monomer and a redox initiator system. The copolymer is then made cationic by reacting the copolymer with a water soluble amine or amine quaternary. Amines, including amine quaternaries, that are useful include, but are not limited to, primary, secondary, and tertiary amines such as ethylene diamine, diethylene triamine, triethylene tetramine, tetraethylene pentamine, or partial or fully quaternized derivatives of any of the foregoing, hydrazides and quaternaries thereof such as betaine hydrazide chloride, N-N-dimethylglycine hydrazide, unsymmetrical dimethyl hydrazides, polymers, such as those formed by reaction of urea and polyalkylene polyamines, guanidines, biguanides, guanylureas, mono and polyhydroxy polyamines and quaternaries thereof, etc. When using this emulsion copolymerization technique, it will be necessary to control molecular weight to within the ranges provided herein. Suitable methods for this are discussed below.

Generally, as the weight average molecular weight of the temporary wet strength additive is decreased, initial wet strength will become smaller and wet strength decay will become faster. The temporary wet strength additives of the present invention should have a molecular weight of at least about 20,000, preferably at least about 70,000. The upper limit for molecular weight will be limited by a combination of the ability of the additive to impart the desired level of strength decay, discussed further below, and practical considerations such as sufficiently low viscosity for application to pulp slurries or pulp sheets and technical and economic concerns related to formation of such high molecular weight additives. Generally, the molecular weight should be less than about 400,000, preferably less than about 300,000, and more preferably less than about 200,000.

Molecular weight can be controlled by such methods that are known to those skilled in the art, such as varying reaction temperature (increased temperature typically results in reduced molecular weight), varying free radical initiator concentration, and utilization of chain transfer agents. Suitable chain transfer agents include, but are not limited to, beta.-mercaptoethanol, thioglycolic acid, glycerol, acetone, and 2-propanol. Other suitable chain transfer agents include, but are not limited to, those described in Polymer Handbook, 2nd edition, J. Brandrup and E. H. Immergut, editors, Wiley-Intersciences (New York), (1975), pp. II-57 through II-104, incorporated by reference herein.

NONLIMITING SYNTHESIS EXAMPLES

Example I

Preparation of a Temporary Wet Strength Additive in Accordance with the Present Invention 2-Hydroxyethylacrylate (179.7 g, 1.548 mole), N,N-dimethyl acrylamide (79.09 g, 0.7978 mole), [3-(methacryloylamino)propyl]trimethyl ammonium chloride (58.70 g, 0.2659 mole), poly(ethylene glycol) methyl ether methacrylate (Mw~475, 22.73 g, 0.0479 mole) 2,2'-azobis(2-amidinopropane) dihydrochloride (2.16 g, 7.99 mmole), 2-propanol (230 ml), and water (2.0 L) are added to a 5 L three neck round bottom flask containing a magnetic stir bar. This solution is sparged with nitrogen for 25 minutes and then the necks are fitted with a gas inlet adapter connected to a nitrogen manifold, a temperature probe, and a stopper. The solution is heated from room temperature to 58° C., with constant stirring under nitrogen, at which point the reaction becomes exothermic. The reaction temperature is maintained between about 58° C. to about 62° C. until the reaction is no longer exothermic. The solution is heated at 58° C. for an additional 20 hours. After cooling to room temperature, the solution is concentrated in vacuo to remove the 2-propanol. The molecular weight of this polymer will typically be about 158,000. The concentrated solution is transferred to a 5 gal. plastic bucket with water (2 L) and potassium bromide (3.16 g, 26.6 mmole) is added and the solution is adjusted to pH 9.5 with sodium hydroxide and then cooled to 10° C. in an ice bath. 4-acetamido TEMPO (57.0 mg, 0.27 mmole) is dissolved in 10 mL of water and added to the solution. Sodium bicarbonate (3.21 g) is added to 190 mL of a NaOCl solution that is 10-12% in available chlorine and the mixture is stirred until the solid dissolves. This solution is then placed into an addition funnel and added dropwise to polymer solution over 30 min. After stirring for an additional 45 min., the solution was warmed to room temperature and adjusted to pH 4.5 with HCl. A 20 mL aliquot is dialyzed against water overnight (Mw cut off=3500) and used to determine the level of aldehyde in the polymer (temporary wet strength additive) as described in the Aldehyde Level Test herein. The result is 1.7 mole %. The Tg of this polymer (temporary wet strength additive) will typically be 66-80° C.

Example II

Preparation of a Temporary Wet Strength Additive in Accordance with the Present Invention 2-Hydroxyethylacrylate (224.5 g, 1.933 mole), N,N-dimethyl acrylamide (91.90 g, 0.9271 mole), [3-(methacryloylamino)propyl]trimethyl ammonium chloride (81.85 g, 0.3708 mole), 2,2'-azobis(2-amidinopropane) dihydrochloride (3.006 g, 11.08 mmole), 2-propanol (270 ml), and water (2.92 L) are added to a 5 L three neck round bottom flask containing a magnetic stir bar. This solution is sparged with nitrogen for 25 minutes and then the necks are fitted with a gas inlet adapter connected to a nitrogen manifold, a temperature probe, and a stopper. The solution is heated from room temperature to 58° C., with constant stirring under nitrogen, at which point the reaction becomes exothermic. The reaction temperature is maintained between about 58° C. to about 62° C. until the reaction is no longer exothermic. The solution is heated at 58° C. for an additional 20 hours. After cooling to room temperature, the solution is concentrated in vacuo to remove the 2-propanol. The molecular weight of this polymer will typically be about 145,000. The concentrated solution is transferred to a 5 gal. plastic bucket with water to a final weight of 8.09 Kg (5.6% solids in polymer) and the solution is adjusted to pH 9.5 with sodium hydroxide. 4-acetamido TEMPO (77.8 mg, 0.365 mmole) is dissolved in 10 mL of water and added to the solution. Sodium bicarbonate (4.47 g) is added to 260 mL of a NaOCl solution that is 10-12% in available chlorine and the mixture is stirred until the solid dissolves. This solution is then placed into an addition funnel and added dropwise to polymer solution over 30 min. After stirring for an additional 45 min. at room temperature, the solution is adjusted to pH 4.5 with HCl. A 20 mL aliquot is dialyzed against water overnight (Mw cut off=3500) and used to determine the level of aldehyde in the polymer (temporary wet strength additive) as described in the Aldehyde Level Test herein. The result is 4.1 mole %. The Tg of this polymer (temporary wet strength additive) will typically be 82-86° C.

Example III

Preparation of a Temporary Wet Strength Additive in Accordance with the Present Invention 2-Hydroxyethylacrylate (144.6 g, 1.245 mole), N,N-dimethyl acrylamide (62.56 g, 0.6311 mole), [3-(methacryloylamino)propyl]trimethyl ammonium chloride (46.45 g, 0.2104 mole), poly(ethylene glycol) methyl ether methacrylate (Mw~1100, 18.51 g, 0.0168 mole) 2,2'-azobis(2-amidinopropane) dihydrochloride (1.71 g, 6.30 mmole), 2-propanol (190 ml), and water (1.63 L) are added to a 5 L three neck round bottom flask containing a magnetic stir bar. This solution is sparged with nitrogen for 25 minutes and then the necks are fitted with a gas inlet adapter connected to a nitrogen manifold, a temperature probe, and a stopper. The solution is heated from room temperature to 58° C., with constant stirring under nitrogen, at which point the reaction becomes exothermic. The reaction temperature is maintained between about 58° C. to about 62° C. until the reaction is no longer exothermic. The solution is heated at 58° C. for an additional 20 hours. After cooling to room temperature, the solution is concentrated in vacuo to remove the 2-propanol. The molecular weight of this polymer will typically be about 148,000. The concentrated solution is transferred to a 5 gal. plastic bucket with water (1 L) and potassium bromide (2.50 g, 21.0 mmole) is added and the solution is adjusted to pH 9.5 with sodium hydroxide and then cooled to 10° C. in an ice bath. 4-acetamido TEMPO (45.0 mg, 0.210 mmole) is dissolved in 10 mL of water and added to the solution. Sodium bicarbonate (3.18 g) is added to 190 mL of a NaOCl solution that is 10-12% in available chlorine and the mixture is stirred until the solid dissolves. This solution is then placed into an addition funnel and added dropwise to the polymer solution over 50 min. After stirring for an additional 30 min., the solution was warmed to room temperature and adjusted to pH 4.5 with HCl. A 20 mL aliquot is dialyzed against water overnight (Mw cut off=3500) and used to determine the level of aldehyde in the polymer (temporary wet strength additive) as described in the Aldehyde Level Test herein. The result is 2.4 mole %. The Tg of this polymer (temporary wet strength additive) will typically be 78-80° C.

Example IV

Preparation of a Temporary Wet Strength Additive in Accordance with the Present Invention 2-Hydroxyethylacrylate (279.9 g, 2.410 mole), N,N-dimethyl acrylamide (54.75 g, 0.5523 mole), [3-(methacryloylamino)propyl]trimethyl ammonium chloride (60.96 g, 0.2762 mole), 2,2'-azobis(2-amidinopropane) dihydrochloride (2.22 g, 8.19 mmole), 2-propanol (190 ml), and water (2.19 L) are added to a 5 L three neck round bottom flask containing a magnetic stir bar. This solution is sparged with nitrogen for 25 minutes and then the necks are fitted with a gas inlet adapter connected to a nitrogen manifold, a temperature probe, and a stopper. The solution is heated from room temperature to 58° C., with constant stirring under nitrogen, at which point the reaction becomes exothermic. The reaction temperature is maintained between about 58° C. to about 62° C. until the reaction is no longer exothermic. The solution is heated at 58° C. for an additional 20 hours. After cooling to room temperature, the solution is concentrated in vacuo to remove the 2-propanol. The molecular weight of this polymer will typically be about 175,000. The concentrated solution is transferred to a 5 gal. plastic bucket with 2 L of water and the solution is adjusted to pH 9.5 with sodium hydroxide. 4-acetamido TEMPO (60 mg, 0.281 mmole) is dissolved in 10 mL of water and added to the solution. Sodium bicarbonate (3.33 g) is added to 195 mL of a NaOCl solution that is 10-12% in available chlorine and the mixture is stirred until the solid dissolves. This solution is then placed into an addition funnel and added dropwise to polymer solution over 30 min. After stirring for an additional 30 min. at room temperature, the solution is adjusted to pH 4.5 with HCl. A 20 mL aliquot is dialyzed against water overnight (Mw cut off=3500) and used to determine the level of aldehyde in the polymer (temporary wet strength additive) as described in the Aldehyde Level Test herein. The result is 3.8 mole %. The Tg of this polymer (temporary wet strength additive) will typically be 67-71° C.

Fibrous Structures/Sanitary Tissue Products

The temporary wet strength additives made by the methods of the present invention are suitable for use in fibrous structures (webs).

In forming fibrous structures and/or sanitary tissue products of the present invention, wet strength additives, if present, can be added as dilute aqueous solutions at any point in the papermaking process where wet strength additives are customarily added. Such nonfibrous additions are described in Young, "Fiber Preparation and Approach Flow" Pulp and Paper Chemistry and Chemical Technology, Vol. 2, pp 881-882, which is incorporated by reference.

In one embodiment, the fibrous structures of the present invention comprise from about 0.005% to about 5% and/or from about 0.1% to about 2% and/or from about 0.1% to about 1% by weight of the fiber.

The fibrous structure (web) of the present invention may be incorporated into a single-ply or multi-ply sanitary tissue product.

The fibrous structure may be foreshortened, such as via creping and/or microcontraction and/or rush transferring, or non-forshortened, such as not creping; creped from a cylindrical dryer with a creping doctor blade, removed from a cylindrical dryer without the use of a creping doctor blade, or made without a cylindrical dryer.

The fibrous structures of the present invention are useful in paper, especially sanitary tissue paper products including, but not limited to: conventionally felt-pressed tissue paper; pattern densified tissue paper; and high-bulk, uncompacted tissue paper. The tissue paper may be of a homogenous or multilayered construction; and tissue paper products made therefrom may be of a single-ply or multi-ply construction. The tissue paper preferably has a basis weight of between about 10 g/m$^2$ and about 120 g/m$^2$, and density of about 0.60 g/cc or less. Preferably, the basis weight will be below about 35 g/m$^2$; and the density will be about 0.30 g/cc or less. Most preferably, the density will be between about 0.04 g/cc and about 0.20 g/cc.

The fibrous structure may be selected from the group consisting of: through-air-dried fibrous structures, differential density fibrous structures, wet laid fibrous structures, air laid fibrous structures, conventional fibrous structures and mixtures thereof.

The fibrous structure may be made with a fibrous furnish that produces a single layer embryonic fibrous web or a fibrous furnish that produces a multi-layer embryonic fibrous web.

The fibrous structures of the present invention and/or paper products comprising such fibrous structures may have a total dry tensile of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structures of the present invention and/or paper products comprising such fibrous structures may have a total wet tensile strength of greater than about 9 g/cm (25 g/in) and/or from about 11 g/cm (30 g/in) to about 78 g/cm (200 g/in) and/or from about 59 g/cm (150 g/in) to about 197 g/cm (500 g/in).

A nonlimiting suitable process for making a fibrous structure of the present invention comprises the steps of providing a furnish comprising a plurality of cellulosic fibers and a wet strength agent; forming a fibrous structure from the furnish and heating/drying the fibrous structure to a temperature of at least about 40° C. and a moisture content of less than about 5%.

Fibrous Structure Additives

In addition to the temporary wet strength additives of the present invention, any fibrous structure/sanitary tissue product additives, including other wet strength additives, known to those skilled in the art may be incorporated into the fibrous structures and/or sanitary tissue products of the present invention so long as the fibrous structures/sanitary tissue products exhibit improved wet strength properties, as described herein, as compared to conventional fibrous structures/sanitary tissue products.

The temporary wet strength additives of the present invention can be used in any type of fibrous structure and/or sanitary tissue product construction. These include: pattern densified tissue paper such as, but not limited to, that disclosed in U.S. Pat. No. 3,301,746, Sanford and Sisson, issued Jan. 31, 1987, U.S. Pat. No. 3,974,025, Ayres, issued Aug. 10, 1976, U.S. Pat. No. 4,191,609, Trokhan, issued Mar. 4, 1980, U.S. Pat. No. 3,821,068, Shaw, issued Jun. 28, 1974, U.S. Pat. No. 3,573,164, Friedberg et al., issued Mar. 30, 1971, and U.S. Pat. No. 3,994,771, Morgan et al., issued Nov. 30, 1976, all incorporated by reference herein; uncompacted, nonpattern-densified tissue paper such as, but not limited to, that disclosed in U.S. Pat. No. 3,812,000, Salvucci et al., issued May 21, 1974 and U.S. Pat. No. 4,208,459, Becker et al., issued Jun. 17, 1980, both incorporated by reference herein; and conventional tissue paper well known in the art, typically made by pressing a wet web at elevated temperatures to dewater and dry said web.

The temporary wet strength additives of the present invention are useful for a wide variety of paper and paper products. As used herein, the terms "paper" and "paper products" include sheet-like masses and molded products containing fibrous cellulosic materials which may be derived from natural sources, such as wood pulp fibers, as well as other fibrous material characterized by having hydroxyl groups attached to the polymer backbone. These include glass fibers and synthetic fibers modified with hydroxyl groups. Cellulosic fibers are preferred. In addition, the present invention encompasses papers made from combinations of cellulosic fibers, or other fibers having hydroxyl-substituted polymer chains, and other fibrous or nonfibrous materials known to the art. The paper products of the present invention preferably contain at least about 70%, more preferably at least about 85%, by weight (dry sheet product basis), cellulosic fibers. Suitable nonfibrous additions are described in Young, "Fiber Preparation and Approach Flow" Pulp and Paper Chemistry and Chemical Technology, Vol. 2, pp. 881-882, which is incorporated herein by reference.

The temporary wet strength additives of the present invention are particularly useful for nonwoven tissue paper products containing cellulosic fibers such as toilet paper, facial tissue, and paper towels. These products will typically have basis weights of between about 8 $g/m^2$ and about 65 $g/m^2$, and densities of between about 0.03 $g/cm^3$ and about 0.60 $g/cm^3$. They can be made according to any of the techniques known to the art.

In forming fibrous structures and/or sanitary tissue products, the temporary wet strength additives of the present invention are preferably added as dilute aqueous solutions at any point in the papermaking process where temporary wet strength additives are customarily added.

The temporary wet strength additives typically are readily absorbed by the cellulose fibers in an aqueous environment at pH values within the range of about 3.5 to about 8.0. The wet strength additives can develop wet strength in fibrous structures and/or sanitary tissue products within this pH range.

Typically, the temporary wet strength additive of the present invention develops its wet strength in fibrous structures and/or sanitary tissue products both at room temperature and at temperatures at which paper is conventionally dried or through-air dried (190° F.-250° F./87° C.-121° C.).

While Applicants do not wish to be bound by theory, it is believed that wet strength in the fibrous structures and/or sanitary tissue products of the present invention is generated by the formation of hemiacetal bonds, which form when the temporary wet strength additive of the present invention bonds to the cellulose (co-crosslinking); and by hemiacetal bonds, which form when the temporary wet strength additive that is attached to one cellulose fiber bonds to a hydroxyl moiety of another temporary wet strength additive that is attached to another fiber (homo-crosslinking). In order to lose wet strength, these same two bonds must break. By controlling the relative number of these bonds, the wet tensile strength and the rate of tensile decay of the cellulose product upon wetting can be controlled.

In forming fibrous structures and/or sanitary tissue products of the present invention, the temporary wet strength additives of the present invention can be added as dilute aqueous solutions at any point in the papermaking process where temporary wet strength additives are customarily added. Such nonfibrous additions are described in Young, "Fiber Preparation and Approach Flow" Pulp and Paper Chemistry and Chemical Technology, Vol. 2, pp 881-882, which is incorporated by reference.

The temporary wet strength additive of the present invention can be applied to the fibrous slurry and/or in-line in a fibrous structure making machine (i.e., papermaking machine) and/or in the furnish, and/or to the embryonic fibrous web and/or fibrous structure and/or sanitary tissue product of the present invention as it is being made on a papermaking machine or thereafter: either while it is wet (i.e., prior to final drying) or dry (i.e., after final drying). Application methods for applying the temporary wet strength additive may include spraying on to the embryonic fibrous web directly or contacting the foraminous wire and/or fabric and/or belt which contacts the web with the temporary wet strength additive, such as by spraying and/or dipping and/or slot extruding and/or brushing on.

A substantial amount of initial wet strength is imparted to the fibrous structures and/or sanitary tissue products of the present invention when from about 0.005% to about 2% of the temporary wet strength additive by weight of the fiber is added. Typically, best results, i.e., around 60% of tensile decay at 5 minutes and around 80% at 30 minutes, are achieved when about 0.1% to about 0.3% of the temporary wet strength additive by weight of the fiber is added, and when from 30 mole percent to about 85 mole percent of the homo-crosslinking monomeric unit is present in the temporary wet strength additive. When lower levels of this homo-crosslinking monomeric unit are added, there is an insufficient amount of wet tensile decay over time. When greater than 85% of the non-nucleophilic monomeric unit is present, the fibrous structures and/or sanitary tissue products of the present invention do not exhibit good initial wet strength.

A nonlimiting example of a suitable wet strength additive for use in the fibrous structures and/or sanitary tissue products of the present invention includes temporary wet strength additives described herein.

Test Methods

Aldehyde Level Test

The aldehyde content of the temporary wet strength additives of the present invention (i.e., the oxidized polymers) is determined using hydroxylamine hydrochloride titration via oxime derivitization by the following procedure. A sample of oxidized polymer solution is dialyzed against water (Mw cut-off=3500) and then the percent solids is determined using a moisture balance. An aliquot of solution containing 0.7-1.0 g of dissolved polymer is titrated to pH 4 using a Metrohm pH stat. To this solution, 15 mL of a 0.3 M hydroxylamine hydrochloride solution adjusted to pH 4 is added. This solution is maintained at pH 4 by titration with standardized 0.1 N sodium hydroxide. The solution is stirred until no further decrease in pH is observed (about 1 hour). The weight percent aldehyde content is calculated using the following equation:

$$\text{weight \%-}CHO = \frac{[(\text{mL of NaOH} \times \text{N of NaOH}/1000) \times Mw \text{ of } CHO \text{ monomer unit}]}{\text{weight of polymer sample}} \times 100$$

% Decay Test Method a. Sample Preparation—Handsheets

If a sample fibrous structure is not in existence, then a sample handsheet can be prepared to test % Decay. Handsheets can be formed from 100% unrefined Northern Softwood Kraft (NSK), mixtures of NSK and Eucalyptus, or from other fibers as desired. After dispersing the NSK, or other fibers, in water, a temporary wet strength resin is added to the disintegrated pulp and the slurry is agitated for a fixed period of time ranging from 1 to 60 minutes. Handsheets are made essentially according to the TAPPI standard T205 with the following exceptions:

(1) the sheet is formed on a polyester wire and dewatered by suction rather than pressing;

(2) the embryonic web is transferred by vacuum to a polyester papermaking fabric;

(3) the sheet is then dried by steam on a rotary drum drier.

b. Testing 1. 11.33 cm (4.5 inch) wide by 10.16 cm (4 inch) long strips of fibrous structure or sanitary tissue product to be tested are prepared. 2.54 cm (1 inch) wide sample strips are cut from the fibrous structure or sanitary tissue product.

2. In a conditioned room where the temperature 23±3° C. (73±4° F.) and relative humidity 50±10% a sample strip [2.54 cm (1 inch) wide] is mounted onto an electronic tensile tester, an EJA Tensile Tester Model No. 1376-18 commercially available from Thwing Albert Instrument Company. The tensile tester is operated at a crosshead speed of 2.54 cm/minute (1 inch/minute). The tensile device is fastened in the lower clamp of the tensile tester such that the horizontal rod was parallel to the clamp faces and is otherwise symmetrically located with respect to the clamps. The position of the lower clamp is adjusted so that the horizontal axis of the rod was exactly 1" (2.54 cm) below the upper clamp.

3. A liquid container is filled to ⅛" (0.3175 cm) from the top of the container with standard tap water which contains 23 ppm calcium ion, 7 ppm magnesium ion and 67 ppm sodium bicarbonate. The sample strip being measured is threaded under the rod in the wet tensile device. The ends of the sample strip are placed together, the slack is removed and the upper clamp fastened. The sample strip is centrally located with respect to the horizontal rod and the upper clamp. The liquid container is raised immersing the looped end of the sample strip to a depth of at least ¾" (1.9 cm). Exactly 5 seconds after the liquid container is raised in place and with the liquid container remaining in place the tensile tester was engaged. The load is recorded. Wet tensile is expressed in g/in (g/2.54 cm) units.

$$\text{Average Wet Tensile (g/in)} = \frac{\text{sum of loads at peak for test runs}}{2 \times \text{number of tensile strips tested}}$$

Wet Tensile is calculated for machine direction (MD) and cross-machine direction (CD). Total Wet Tensile (TWT) =Avg. Wet Tensile (MD)+Avg. Wet Tensile (CD)

4. Next, a sample strip is clamped to the Intelect 500 as described above in Step 3. The liquid container is raised to its uppermost position immersing the looped end of the specimen to a depth of at least ¾" (1.9 cm) in the standard tap water. 5 minutes after the liquid container is raised in place the wet tensile load is again read.

$$\%\ \text{Decay} = \frac{(TWT\ 5\ \text{sec soak} - TWT\ 5\ \text{min soak})}{TWT\ 5\ \text{sec soak}} \times 100$$

5. Step 4 is repeated except that the sample strip is immersed in the standard tap wait for 30 minutes rather than 5 minutes. The % Decay is calculated as follows:

$$\%\ \text{Decay} = \frac{(TWT\ 5\ \text{sec soak} - TWT\ 30\ \text{min soak})}{TWT\ 5\ \text{sec soak}} \times 100$$

To illustrate nonlimiting embodiments of the present invention, handsheets containing the temporary wet strength resins of Examples I-IV and a prior art temporary wet strength additive, Parez® (Bayer Chemicals), were prepared as described herein and tested for initial wet tensile and % Decay as described in the Decay Test Method. Results are presented below:

| Wet Strength Additive | Usage Rate (lbs./ton) | Initial Wet Tensile (g/in) | Wet Tensile Decay (%) 5 min | 30 min |
|---|---|---|---|---|
| Parez 750C ® | 7 | 71 | 38 | 67 |
| Example I | 4 | 74 | 74 | 81 |
| Example II | 4 | 81 | 61 | 79 |
| Example III | 4 | 74 | 60 | 82 |
| Example IV | 3 | 91 | 45 | 79 |

All documents cited in the Detailed Description of the Invention are, in relevant part, incorporated herein by reference; the citation of any document is not to be considered as an admission that it is prior art with respect to the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for making a temporary wet strength additive comprising the step of oxidizing a reversible, homo-crosslinking monomeric unit present in a polymer comprising the reversible, homo-crosslinking monomeric unit and a cationic monomeric unit such that a temporary wet strength additive is produced wherein the reversible, homo-crosslinking monomeric unit is derived from a monomer having the following structure:

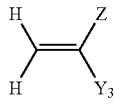

wherein $Y_3$ is —H, —$CH_3$, or a halogen; and Z is a nucleophilic moiety capable of forming an unstable covalent bond with an electrophilic moiety.

2. The method according to claim 1 wherein Z is:

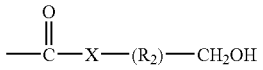

wherein $R_2$ is a substituted or unsubstituted, branched or linear aliphatic group and X is O, NH, or $NCH_3$.

3. The method according to claim 2 wherein X is O.

4. The method according to claim 1 wherein the cationic monomeric unit is derived from any polymerizable monomer which imparts a positive charge to the temporary wet strength additive.

5. The method according to claim 1 wherein the polymer further comprises a non-nucleophilic monomeric unit.

6. The method according to claim 5 wherein the non-nucleophilic monomeric unit is derived from a monomer having the following structure:

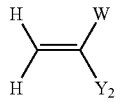

wherein W is a non-nucleophilic moiety or a nucleophilic moiety that does not form a stable covalent bond with an electrophilic moiety; and $Y_2$ is H, $CH_3$, or a halogen.

7. The method according to claim 6 wherein W is a N,N-dialkyl acrylamide moiety and/or a carboxylic acid moiety.

8. The method according to claim 1 wherein the temporary wet strength additive has the following formula:

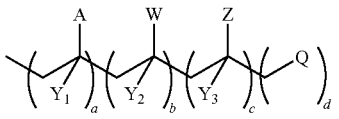

wherein: A is:

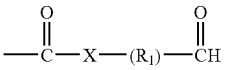

Z is:

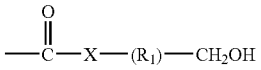

and X is —O—, —NH—, or —$NCH_3$—, and $R_1$ is a substituted or unsubstituted aliphatic group: $Y_1$, $Y_2$, and $Y_3$ are independently —H, —$CH_3$, or a halogen; Q is a cationic monomeric unit; and W is a non-nucleophilic moiety or a nucleophilic moiety that does not form a stable covalent bond with an electrophilic moiety, wherein the mole percent of a is from about 1% to about 47%, the mole percent of b is from about 0% to about 70%, the mole percent of c is from about 10% to about 90%, and the mole percent of d is from about 1% to about 40%.

9. The method according to claim 8 wherein a is from about 2% to about 30%, b is from 0% to about 60%, c is about 30% to about 80%, and d is about 2% to about 20%.

10. The method according to claim 8 wherein A is

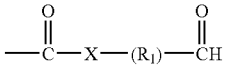

and $R_1$ comprises a $C_1$-$C_7$ aliphatic chain.

11. The method according to claim 8 wherein Z is

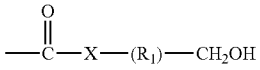

and $R_2$ is a $C_1$-$C_4$ aliphatic chain.

12. The method according to claim 11 wherein the monomeric unit containing Z is selected from the group consisting of 2-hydroxyethyl acrylate, 2-hydroxyethyl methacrylate, 3-hydroxypropyl acrylate, 3-hydroxypropyl methacrylate, 4-hydroxybutyl acrylate, 4-hydroxybutyl methacrylate, diethyleneglycol mono-methacrylate, poly(ethyleneglycol) mono-acrylate, and poly(ethyleneglycol) mono-methacrylate.

13. The method according to claim 8 wherein the monomeric unit containing W is selected from the group consisting of N,N-dialkyl acrylamides, alkyl acrylates, alkyl methacrylates and carboxylic acids.

14. The method according to claim 8, wherein the monomeric unit containing W is an N,N-dialkyl acrylamide, the monomeric unit containing Z is 2-hydroxyethyl acrylate, and A is derived from the oxidation of 2-hydroxyethyl acrylate monomeric units.

15. The method according to claim 1 wherein said temporary wet strength additive has a weight average molecular weight of at least about 70,000.

16. The method according to claim 15 wherein said weight average molecular weight of from about 70,000 to about 400,000.

17. A method for making a temporary wet strength additive comprising the steps of:

a) providing a reversible, homo-crosslinking monomeric unit;

b) providing a cationic monomeric unit;

c) polymerizing the monomeric units from a) and b) above to produce a polymer comprising a reversible, homo-crosslinking monomeric unit and a cationic monomeric unit;

d) oxidizing a portion of the reversible, homo-crosslinking monomeric units to provide a temporary wet strength additive wherein the method further comprises the step of providing a non-nucleophilic monomeric unit such that the non-nucleophilic monomeric unit is polymerized along with the monomeric units from a) and b) to produce a polymer comprising a reversible, homo-crosslinking monomeric unit, a cationic monomeric unit and a non-nucleophilic monomeric unit.

* * * * *

UNITED STATES PATENT AND TRADEMARK OFFICE

CERTIFICATE OF CORRECTION

PATENT NO. : 7,598,331 B2
APPLICATION NO. : 11/355667
DATED : October 6, 2009
INVENTOR(S) : Barcus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 845 days.

Signed and Sealed this

Twenty-eighth Day of September, 2010

David J. Kappos

David J. Kappos
*Director of the United States Patent and Trademark Office*